US006772471B1

(12) United States Patent
Rossouw

(10) Patent No.: US 6,772,471 B1
(45) Date of Patent: Aug. 10, 2004

(54) FLUID APPLICATOR ENGAGEMENT DEVICE

(76) Inventor: Francois Jacobus Rossouw, 1 Roussouw Road, Bedfordview, Johannesburg (ZA), 2007

( * ) Notice: Subject to any disclaimer, the term of this patent is extended or adjusted under 35 U.S.C. 154(b) by 0 days.

(21) Appl. No.: 09/831,026

(22) PCT Filed: Sep. 16, 1999

(86) PCT No.: PCT/ZA99/00090

§ 371 (c)(1),
(2), (4) Date: May 4, 2001

(87) PCT Pub. No.: WO00/26038

PCT Pub. Date: May 11, 2000

(30) Foreign Application Priority Data

Nov. 4, 1998 (ZA) ..... 98/10140
Mar. 8, 1999 (ZA) ..... 99/1818

(51) Int. Cl.[7] ..... B05C 21/00
(52) U.S. Cl. ..... 15/257.06; 15/257.05
(58) Field of Search ..... 15/257.05, 257.06

(56) References Cited

U.S. PATENT DOCUMENTS 2,778,050 A 1/1957 Meinhardt ..... 15/257.06
2,939,162 A * 6/1960 Kravitt ..... 15/257.05
3,761,995 A * 10/1973 Rinard ..... 15/257.06
3,894,650 A 7/1975 Crump ..... 220/701
4,020,523 A * 5/1977 Brown ..... 15/257.05
4,566,148 A * 1/1986 Rolin ..... 15/257.05
4,691,838 A * 9/1987 Graham et al. ..... 15/257.06
5,533,802 A 7/1996 Garganese ..... 366/256

FOREIGN PATENT DOCUMENTS

DE 21 40 189 2/1973

* cited by examiner

*Primary Examiner*—Theresa T. Snider
(74) *Attorney, Agent, or Firm*—Young & Thompson

(57) ABSTRACT

An applicator engagement device for a fluid applicator is in the form of a float, which is adapted in use to fit within a bucket containing paint. The float, which is a plastics moulding, comprises a peripheral ring which is of inverted "U"-shape in section and faces downwardly. The ring is spanned by three equi-spaced flexible arms radiating from a central ring to join the ring at its edge, this flexibility permitting the last bit of fluid to be gotten to by the roller. The arms are narrow so that area circumscribed by the ring is substantially open to permit paint to pass therethrough. The ring is sized to permit a stirrer, such as a paddle to be inserted therethrough into the bucket to stir the paint without the need to remove the float from the bucket.

18 Claims, 6 Drawing Sheets

FLUID APPLICATOR ENGAGEMENT DEVICE

FIELD OF THE INVENTION

This invention relates to a fluid applicator engagement device. In particular, the invention relates to said engagement device for an applicator for a viscous fluid coating composition, such as paint.

BACKGROUND OF THE INVENTION

Paint and other coating compositions for application to large surface areas are normally supplied in large buckets or drums. In South Africa, typical bucket sizes in which paint is normally supplied to domestic consumers include both round and polygonal cylindrical 20 and 25 liter buckets. When paint is to be applied by an applicator such as a roller, the paint is normally dispensed into a tray in which a roller surface will be brought into contact with paint and the paint is applied to the roller surface. This tray has a small capacity and must be regularly refilled. The large paint bucket, especially the twenty five liter bucket, normally has a diameter greater than the axial length of the roller. Thus painters are inclined to saturate the roller directly in the bucket thereby obviating the necessity of charging and recharging the tray, and thereby also attempting to maximise the surface coverage per charge of paint on the roller. Although this technique has its advantages, a major problem arises in that the roller does not turn on its bearings when brought into contact with the paint so that it does not operate satisfactorily as the roller is submerged in the paint Furthermore, the paint needs to be stirred periodically and thus any obstruction of the mouth of the bucket which does not permit stirring of the paint in the bucket without first removing the obstruction is undesirable.

SUMMARY OF THE INVENTION

According to one aspect of the invention there is provided a fluid applicator engagement device useful for an applicator for a fluid to be applied from a container, said device having a support sized and dimensioned complementarily to the container to permit axial movement of said support within the container, said device having fluid applicator engaging means co-operating with said support, said device being characterised in that a substantially central opening is provided to permit a stirrer element to be inserted therethrough into the container for, in use, stirring the fluid in the container and also facilitating maximum fluid contact with the applicator therethrough.

The support may be of a material selected to float on the fluid in the container. Thus the axial movement of the device in the container may be due to the device floating on a changing fluid level within the container.

The substantially central opening may be circular, oval, polygonal, rectangular, square, or the like.

In this specification, unless the context clearly indicates to the contrary, the terms "float", "floatable" and "floating", are to be understood as meaning that the applicator engagement device is only slightly submerged and in large part lies on top of the fluid surface.

The support may be a support in the form of a ring.

The ring may define the periphery of the device.

The support may be of larger cross sectional dimension than the axial length of the fluid applicator with which it is to be used, said support being adapted to float at or on the surface of the fluid with the fluid applicator engaging means at or just above the surface of the fluid.

Where the fluid applicator is a roller, the support and fluid applicator engaging means are adapted so that the roller can be rolled over at least part of the fluid applicator engaging means and come in contact with the fluid in the container.

Typically, the fluid in the container is a coating composition, such as paint, and the roller picks up the paint onto its applicator surface or nap by the action of rolling it over the fluid applicator engaging means and bringing the applicator surface or nap into contact with the paint surface in the container.

The fluid applicator engaging means conveniently comprises spaced arms within the support, conveniently including a centre piece from which the arms radiate.

The arms may be made of a flexible material, the length of the arms determining the freedom of movement of the centre piece relative to the support.

The arms may be made of a resiliently deformable material.

The centre piece may be biased by the resiliently deformable arms into the plane of the support, or to any other required plane which determines the depth of immersion of the applicator engaging element in the fluid.

The centre piece may comprise the substantially central opening. Projections are preferably provided on the centre piece and/or the arms to engage the fluid applicator, where the fluid applicator is a roller, to cause it to rotate.

However, an upper surface of the arms may be substantially co-planar with the plane of the support.

The support may conveniently be of inverted channel-shape section to assist it to float.

The support and/or the arms and/or the centre piece may be provided with an axially directed lip or flange to increase the fluid drag of the device and to inhibit dunking thereof in the fluid.

The support may however be made of any material having a density lower than that of the fluid in the container, for example, wood, plastic, polyurethane foam, foam rubber, polystyrene, rubber, or the like.

The support is typically made of a material which has a buoyancy only slightly higher than that of the fluid.

The support may be made of a plastic material having a cellular nature, such that the air trapped in the cells contributes to the buoyancy thereof. The cells may be small to inhibit the entrapped air in the cells from escaping if the device is tilted at an angle to the containers longitudinal axis.

The projections may comprise elongated lugs which are upstanding above the plane of the support. Alternatively the projections may be triangular lugs, or the like.

In another embodiment, the support is non-planar in cross section and adapted to include a fluid applicator engaging portion while being provided with a stirrer aperture configured to permit the fluid in the container to be stirred without removing the applicator engagement device from the container.

Typically the support of this embodiment is dimensioned to engage the end zones of a roller fluid applicator, such as a paint roller, and to bring said applicator into contact with the fluid in the container.

In a typical embodiment, the cross section is arcuate, for example, parabolic, hyperbolic, or the like.

The applicator engagement device may be provided with a floor co-operable with the support, the floor being adapted to permit engagement with a fluid applicator while permitting a desired quantity of fluid to come into contact with the applicator.

The device may have a logo, or other information provided thereon, such that when the applicator engagement device is floating in a fluid the logo or other information may be read.

The floor may have a plurality of perforations distributed over its extent, or be in the form of a grid or an apertured screen.

According to a further aspect of the invention there is provided a container for a fluent coating composition, the container including a lid and an applicator engagement device substantially as described above.

The fluid engagement device may be integral with the lid, the lid being provided with removable zones configured such that when the removable zones are removed the remainder of the lid forms said device in accordance with the invention.

The removable zones may have frangible borders to the remainder of the lid in order to facilitate removal thereof.

DESCRIPTION OF THE DRAWINGS

Embodiments of the invention will now be described by way of example with reference to the accompanying drawings.

In the drawings:

Referring now to FIGS. 1, 2, 3, 10, 11 and 12, there is provided an applicator engagement device of the invention, in the form of a float 10, which is adapted in use to fit within a bucket 12 containing paint 14.

Figure 1:
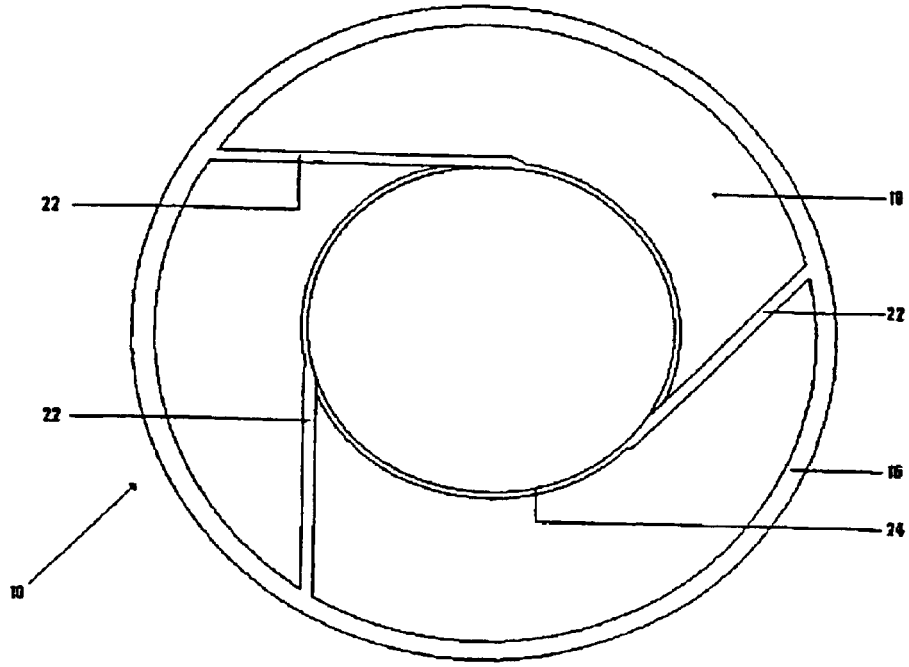
FIG. 1 is a top plan view of an applicator engagement device of the invention.
Figure 2:
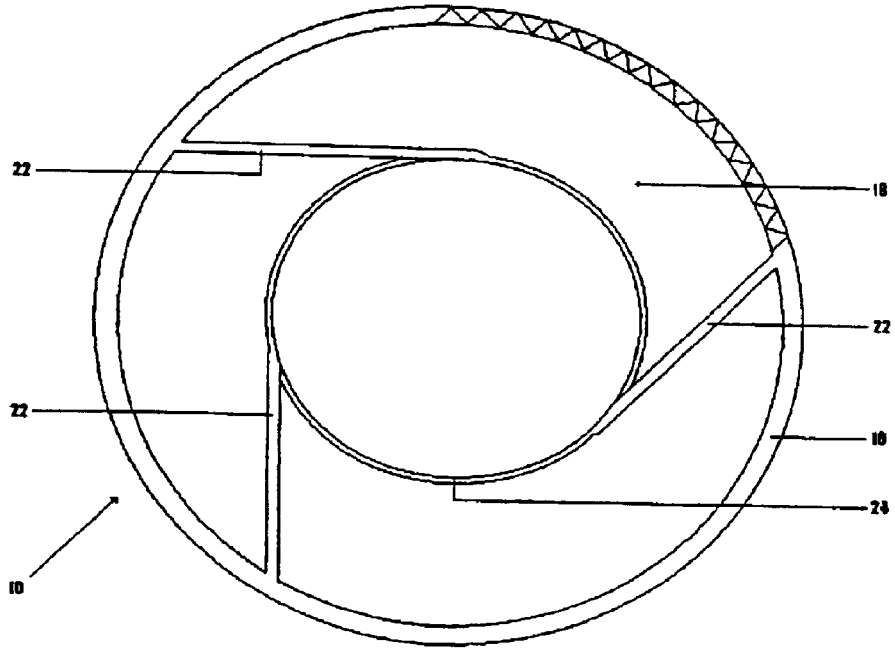
FIG. 2 is a bottom plan view of the device of FIG. 1.
Figure 3:
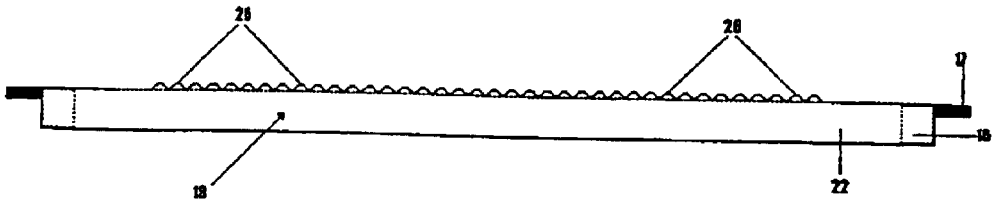
FIG. 3 is a section of FIGS. 1 and 2.

The float 10, which is a plastic moulding, comprises a peripheral ring 16 which is of inverted "U"-shape in section and faces downwardly and has a lip 17. The ring 16 is spanned by three equi-spaced flexible arms 22 radiating from a central engagement ring 24 to join the ring 16 at its top edge. The arms 22 are narrow so that the area circumscribed by the ring 16 is substantially open to permit paint to pass therethrough. The engagement ring 24 is sized to permit a stirrer, such as a paddle 25 to be inserted therethrough into the bucket 12 to stir the paint 14 without the need to remove the float 10 from the bucket 12. The engagement ring 24 is substantially circular and is located centrally or co-axially within the ring 16.

On the engagement ring 24 there are provided roller engagement projections 26. These projections 26 are elongated lugs and extend above the height of the ring 16.

Figure 11:
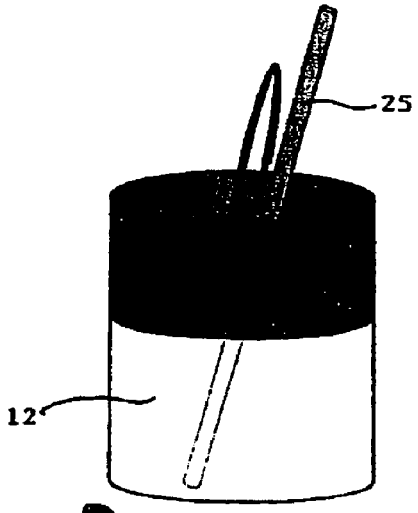
FIG. 11 is a schematic of bucket with a stirrer paddle.
Figure 12:
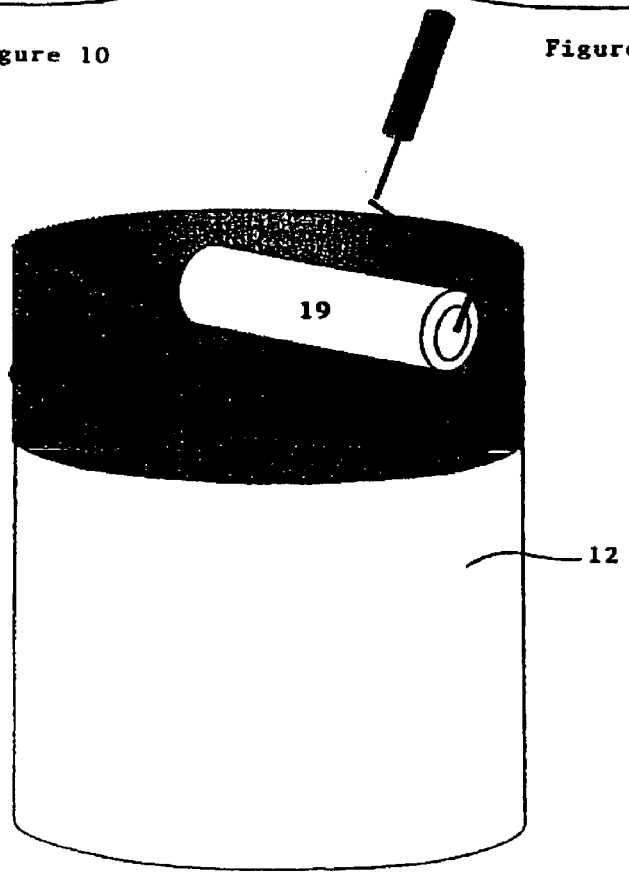
FIG. 12 is schematic of a roller in use in a bucket with an applicator engagement device.

The dimensions of the float 10 are such that its maximum diameter is 250 mm which is appropriate to fit into most 25 liter buckets which normally have a diameter of 280 mm, or more. (i.e. there is a space between the periphery of the ring 16 and the interior of the pail contrary as shown in FIG. 11). The arms 22 extend between the ring 16 and the engagement ring 24 so that the engagement ring 24 is in the same plane as the ring 16. The arms 22 are conveniently about 2 mm thick and 4 mm wide resiliently deformable plastic.

The height of the projections 26 is approximately 5 mm and, standing on the engagement ring 24 gives an overall height of 15 mm.

In use, the float 10 is dropped on to the surface of the paint whereafter the paint 14 in the bucket 12 is stirred. The ring 16, and in particular the air entrapped therein, will cause the float 10 to float on the surface but with the engagement ring 24 on top of the paint. A workman can now charge or load a roller 19 by running the roller over the arms 22, engagement ring 24 and/or ring 16 of the float 10. The projections 26 will engage the surface of the roller to cause it to rotate when it is moved over the arms 22, engagement ring 24 and/or ring 16. The resiliency of the arms 22 will inhibit the roller from being depressed too deeply into the paint so that only the surface of the roller will be to charged with paint It will be understood of course that should the workman wish to force the float downwardly he would be able to do so, but knowing the disadvantage of so doing, he will be inhibited from so doing by the float.

The resiliency of the arms 22 also permits the last remaining paint in is the bucket to be used. When the bucket is substantially empty the ring 16 lies on the bottom of the bucket and when the roller is pressed onto the engagement ring 24 and the arms 22, the engagement ring 24 will be pressed into the remaining paint thereby permitting it to be picked up by the roller.

Figure 4:
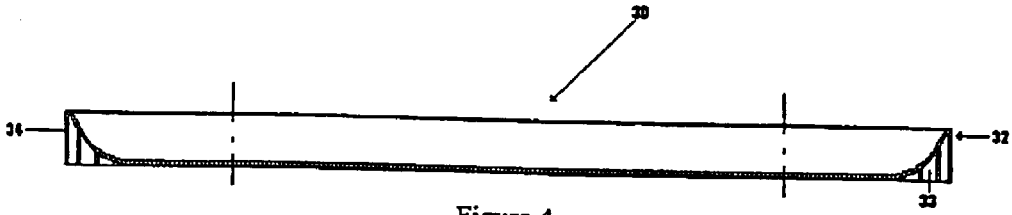
FIG. 4 is a section of a further float of the invention.
Figure 5:
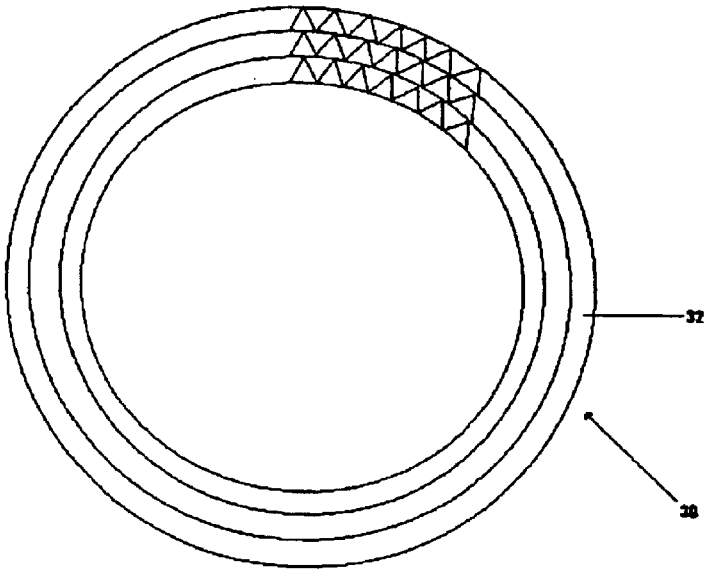
FIG. 5 is a plan view of FIG. 4.

Reference is now made to FIGS. 4 and 5 which show a float 30 which is similar to float 10. However, float 30 has a supporting ring 32 having a substantially parabolic cross section 33 extending from the perimeter 34 to the central opening 36. In use, the parabolic section 33 engages the end zones of a roller thereby rotating the roller for taking up paint onto its surface.

Figure 6:
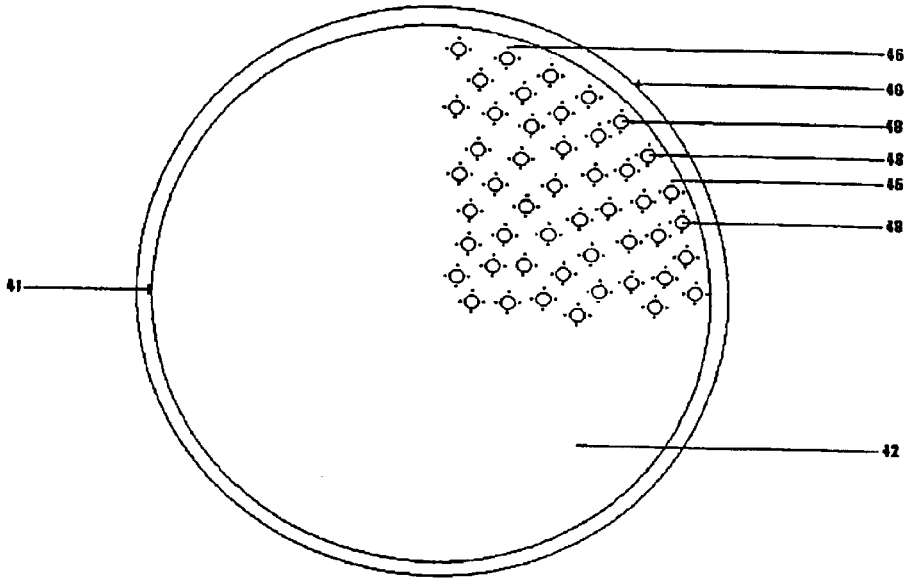
FIG. 6 is a bottom plan of a floor useable with the device.
Figure 7:
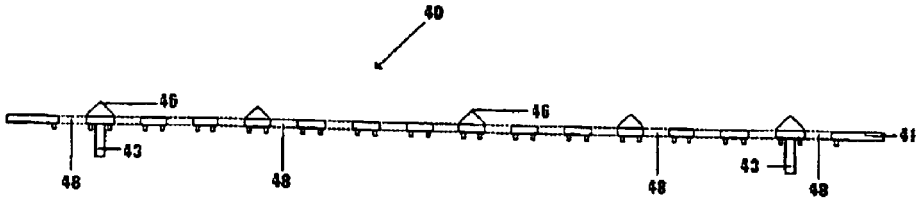
FIG. 7 is a section through the floor of FIG. 6.

Reference is now made to FIGS. 6 and 7 which show a floor 40 that is usable with float 30 The floor 40 has a perforated element 42. The floor 40 has projections 46 for engaging with a roller and drainage apertures or perforations 48 to permit paint to come into contact with the roller and to drain excess paint back again. The floor 40 has downwardly directed locating pins 43 for locating the floor 40 within float 30.

Figure 8:
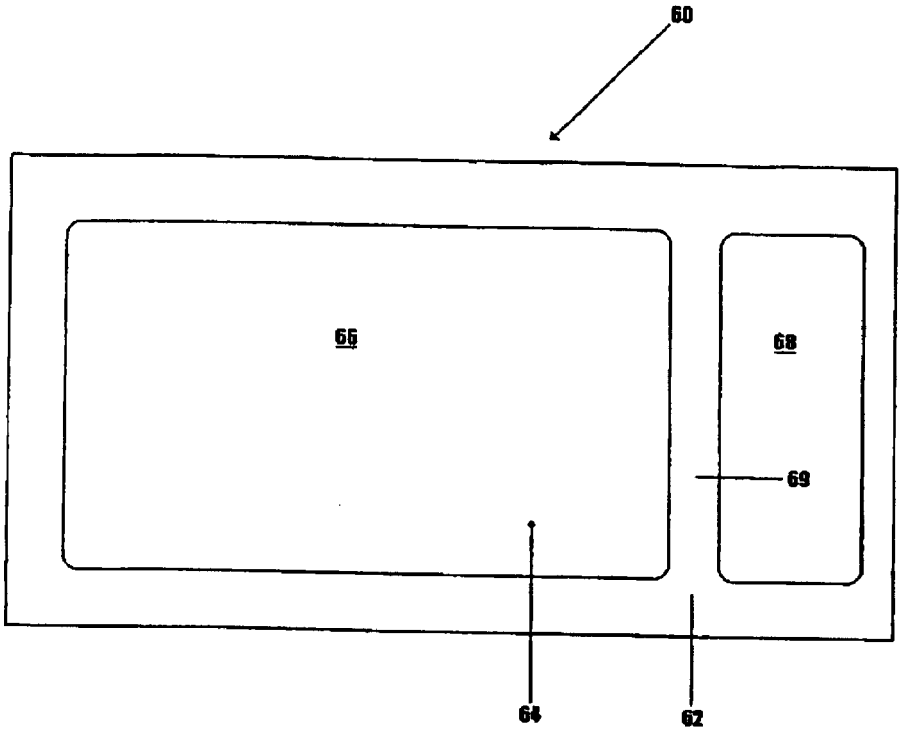
FIG. 8 is a plan view of a rectangular device in accordance with the invention.
Figure 13:
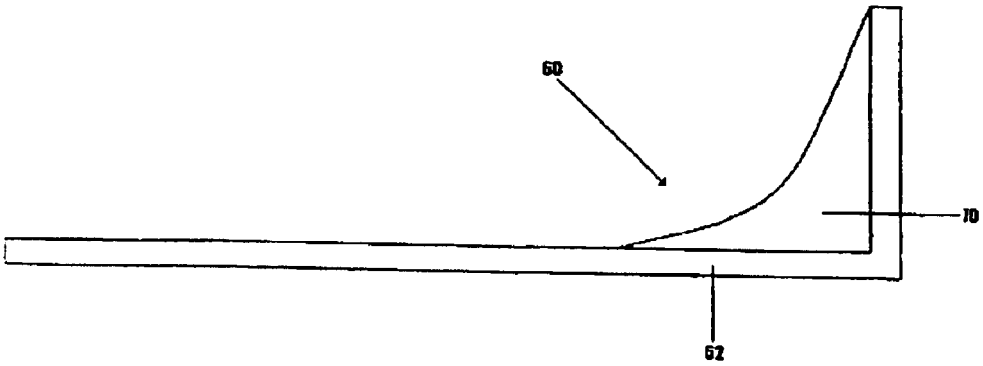
FIG. 13 is a side section view of the device of FIG. 8.
Figure 9:
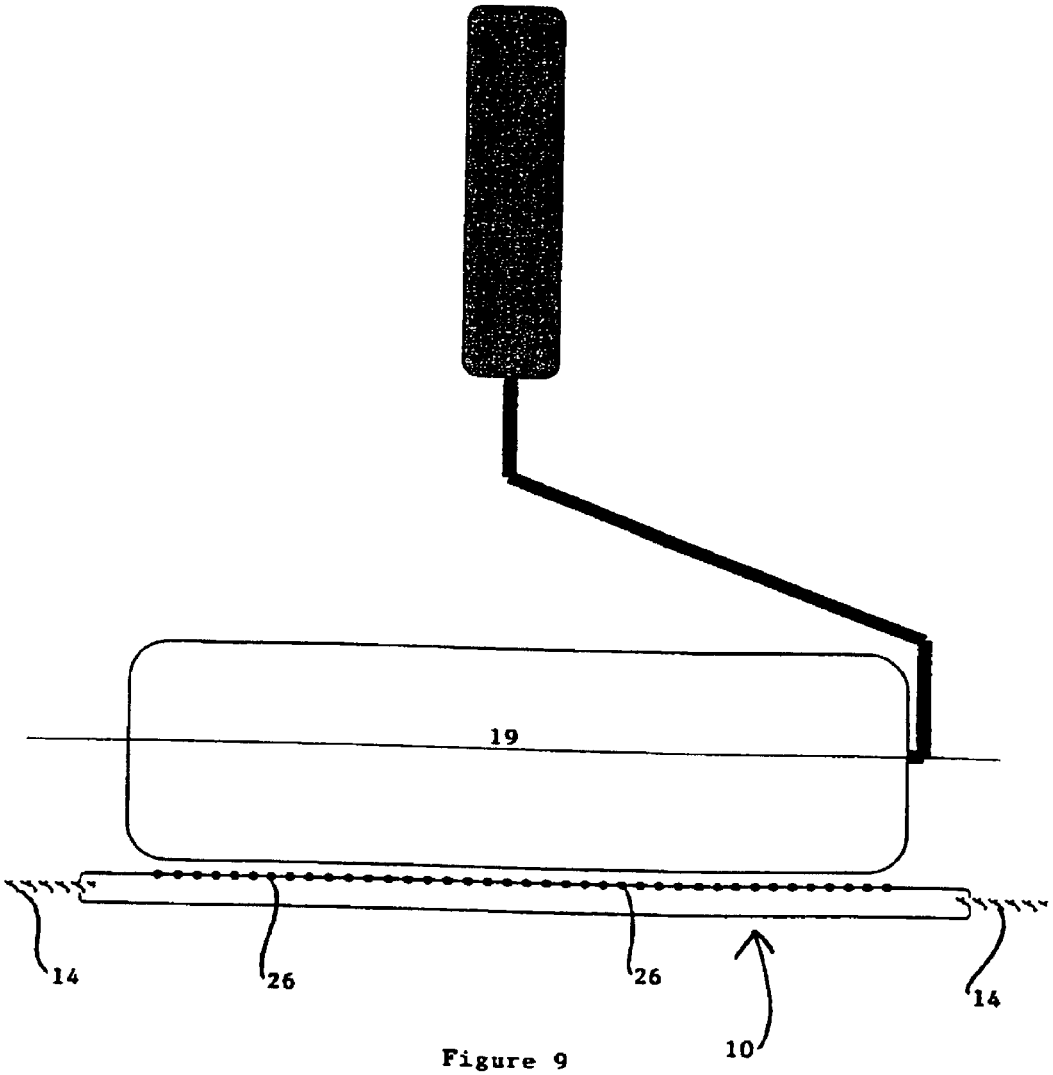
FIG. 9 is schematic view of a paint roller in use with the device.
Figure 10:
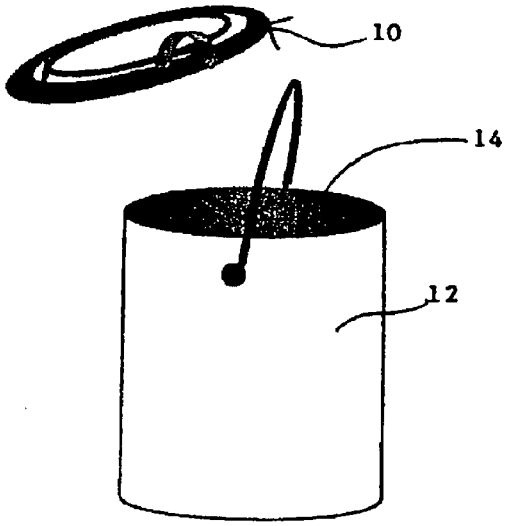
FIG. 10 is a schematic of an applicator engagement device being placed into a bucket.

Reference is now made to FIGS. 8 and 13, which show a float 60 which is similar to float 30. However, float 60 has a supporting ring 62 which is rectangular and having a divided central opening 64, which is divided into a larger opening 66 and a smaller opening 68 by a cross member 69 so as to permit smaller rollers to be used therewith. In use, the supporting ring 62 and cross member 69 engage the end zones of a roller thereby rotating the roller for taking up paint onto its surface.

The float 60, as shown in FIG. 13, has a wiper portion 70 extending upwardly from the suporting ring 62 in an arcuate fashion so as to facilitate wiping of excess paint of the roller prior to taking it out of the container.

The invention is not limited to the precise constructional details hereinbefore described and illustrated in the drawings. For example, a lifting tab may be provided to facilitate the removal of the float from the bucket.

The inventor believes that a device made in accordance with the invention as illustrated has several advantages:

because in some embodiments the roller ends engage the device, the roller ends have less paint applied to them and thus are less likely to drip;

because of the central opening and the equi spaced arms being quite narrow in comparison to the overall area of the device, high fluid to roller contact area is maintained in the container even when the device is floating an the surface of the fluid; and the resiliently deformable arms, besides permitting the last bit of fluid to be gotten to by the roller, also assist in the stirring of the fluid in the container by deforming and permitting the centre piece to be displaced during the stirring action.

What is claimed is:

1. A paint applicator which includes:

an engagement member, a buoyant peripheral member, a plurality of flexible arms which extend from the engagement member and which join the peripheral member, and a plurality of spaced projections on the engagement member adapted to engage a roller moving over the engagement member thereby to cause rotation of the roller, wherein the arms are resiliently deformable to allow limited movement of the engagement member relative to the peripheral member.

2. The paint applicator of claim 1, wherein the arms are equi-spaced.

3. The paint applicator of claim 1, wherein the arms extend non-radially from the engagement member.

4. The paint applicator of claim 1, wherein the engagement member is substantially circular.

5. The paint applicator of claim 1, wherein the peripheral member is substantially circular.

6. The paint applicator of claim 1, wherein the peripheral member is made from a plastic material of a cellular nature.

7. The paint applicator of claim 1, wherein the peripheral member is formed with a plurality of cells which are small to inhibit entrapped air in the cells from escaping if the peripheral ring is tilted relative to a paint surface on which the peripheral member is placed.

8. The paint applicator of claim 1, wherein the engagement member defines an opening which is sufficiently large to permit insertion of a stirrer into paint with which the paint applicator is used.

9. The paint applicator of claim 1, which includes a lip to inhibit dunking at least of the peripheral member in paint with which the paint applicator is used.

10. The paint applicator of claim 1, wherein the peripheral member is formed from a foam material.

11. A paint applicator which includes a buoyant supporting member with a surface which extends, in use, downwardly from a periphery to a central opening, wherein the surface is non-planar.

12. The paint applicator of claim 11, wherein the member is made from a foam material.

13. The paint applicator of claim 11, wherein the member is made from a plastic material of a cellular nature.

14. The paint applicator of claim 11, wherein the surface is arcuate.

15. The paint applicator of claim 11, wherein the member is dimensioned to engage with end zones of a roller fluid applicator, to rotate a roller and to bring a roller into contact with paint with which the paint applicator is used.

16. The paint applicator of claim 11, which includes a floor covering the central opening, which is formed with a plurality of apertures.

17. The paint applicator of claim 11, wherein the member has a shape which is rectangular, square or circular.

18. The paint applicator of claim 1, which is buoyant when floated on paint.

* * * * *